US011382363B2

(12) United States Patent
Fildan et al.

(10) Patent No.: US 11,382,363 B2
(45) Date of Patent: Jul. 12, 2022

(54) UNDERWIRE FOR A BRASSIERE AND A BRASSIERE INCORPORATING SAME

(71) Applicants: Gerhard Fildan, Vienna (AT); Karl Wanzenboeck, Teesdorf (AT)

(72) Inventors: Gerhard Fildan, Vienna (AT); Karl Wanzenboeck, Teesdorf (AT)

(73) Assignee: DUBROSKY & TRACY PATENT SERVICE CORP., Central (HK)

( * ) Notice: Subject to any disclaimer, the term of this patent is extended or adjusted under 35 U.S.C. 154(b) by 419 days.

(21) Appl. No.: 16/503,837

(22) Filed: Jul. 5, 2019

(65) Prior Publication Data

US 2019/0328051 A1 Oct. 31, 2019

Related U.S. Application Data

(63) Continuation-in-part of application No. 15/285,958, filed on Oct. 5, 2016, now abandoned.

(30) Foreign Application Priority Data

Oct. 5, 2015 (GB) ..... 1517572

(51) Int. Cl.
*A41C 3/12* (2006.01)
*A41C 3/00* (2006.01)

(52) U.S. Cl.
CPC ..... *A41C 3/128* (2013.01); *A41C 3/0007* (2013.01)

(58) Field of Classification Search
CPC ..... A41C 3/128; A41C 3/0007
USPC ..... 450/51
See application file for complete search history.

(56) References Cited

U.S. PATENT DOCUMENTS 4,235,240 A * 11/1980 Cousins ..... A41C 3/122 450/52
5,141,470 A 8/1992 Morgan et al.
7,425,170 B1 9/2008 Herbert et al.
2005/0124261 A1 6/2005 Martini
2005/0197043 A1 9/2005 Horta et al.
2011/0159780 A1 6/2011 Yao
(Continued)

FOREIGN PATENT DOCUMENTS

CN 201282744 Y 8/2009
CN 103126090 A 6/2013
(Continued)

*Primary Examiner* — Timothy K Trieu
(74) *Attorney, Agent, or Firm* — Kintner IP, LLC; Mary Frances Ludwig

(57) ABSTRACT

An underwire for a brassiere comprises an elongate, substantially u-shaped body having a chest-engaging portion and a breast-engaging portion. The underwire is constructed from a unitary piece of plastic material. The chest-engaging portion and the breast-engaging portion are connected together along their lengths in a dogleg-shaped configuration, with, in an embodiment, an angle of between 110° and 140° with respect to each other. The breast-engaging portion has a shorter length dimension than the chest-engaging portion and thereby leaves a substantially flat chest-engaging portion at each end of the elongate body. In embodiments, these flat ends of the chest-engaging portion are rounded or thinned compared to the remainder of the chest-engaging portion. The configuration provides good support to the wearer's breast, increases comfort, and is less likely to injure than other configurations.

18 Claims, 3 Drawing Sheets

(56) References Cited

U.S. PATENT DOCUMENTS

| | | | | |
|---|---|---|---|---|
| 2012/0178341 | A1 | 7/2012 | Cheung | |
| 2012/0184181 | A1 | 7/2012 | Liu | |
| 2013/0137340 | A1 | 5/2013 | Liu | |
| 2014/0227943 | A1* | 8/2014 | McNeeley ..... | A41C 3/0007 450/41 |
| 2015/0004874 | A1 | 1/2015 | Zhang | |
| 2016/0044973 | A1 | 2/2016 | Lelong | |
| 2016/0324223 | A1 | 11/2016 | Yip | |

FOREIGN PATENT DOCUMENTS

| | | | |
|---|---|---|---|
| SG | 188025 | | 3/2013 |
| WO | 2009026752 | A1 | 3/2009 |

* cited by examiner

UNDERWIRE FOR A BRASSIERE AND A BRASSIERE INCORPORATING SAME

CROSS REFERENCE TO RELATED APPLICATION

This application is a continuation-in-part of U.S. patent application Ser. No. 15/285,958 filed on 5 Oct. 2016, which claims priority to United Kingdom patent application 1517572.2 filed on 5 Oct. 2015, each of which is incorporated by reference as if fully recited herein.

TECHNICAL FIELD

This invention relates to an underwire for a brassiere and a brassiere or other like garment incorporating the underwire. More specifically, the present invention relates to an underwire particularly suited for use in the manufacture of sports brassieres.

BACKGROUND OF THE INVENTION

It is estimated that underwire brassieres ("bras") now account for approximately 70% of both the United Kingdom and United States bra markets, making them the most popular type of bras currently available. The underwire construction helps to lift, separate, shape or support a woman's breasts whilst also being aesthetically pleasing and relatively comfortable to wear.

The underwire may be constructed from metal, plastic, or resin. For those bras with a metal underwire, it is common to use either a carbon steel wire or a piano steel wire. The advantages of using a metal underwire are that the wire is strong and therefore relatively thin wire can be used to provide sufficient support. Furthermore, the wire can be handled symmetrically which simplifies manufacture of the bra.

However, there are problems associated with the use of carbon steel wire and piano steel wire. One problem with regular carbon steel wires or piano steel wires is that these wires are very hard and unyielding. Therefore, the wires can easily poke into the breast which may cause great discomfort to the wearer and is believed by some to be a cause of breast cancer. Furthermore, these wires are generally flat and run along the contour of the breast with the flat part lying against the wearer's chest. When the wing sides of the bra are pulled back for closing a fastener in the back of the bra, the wire can be lifted away from the front of the chest and the breast can slip out easily through the gap. This scenario is especially problematic for big sizes and bigger breasts and is an inconvenience and can cause discomfort.

It is understood that approximately 80% of sports bras are wireless bras. These bras offer less support to the breast. Those sports bras that do have underwires offer more support but are perhaps not as comfortable as would be desired.

Various alternative constructions of underwire have been proposed to address at least some of the above-identified problems. United States Patent App. Pub. No. US2011/0159780, in the name of Yao, discloses an underwire for a brassiere in which there is a semi-rigid wire core surrounded by a protective, softer coating. Although more comfortable than many of the known alternatives, this configuration is considered to be relatively expensive to manufacture. Furthermore, it may provide insufficient support for a fuller breast as the soft outer coating is not necessarily equipped to bear the weight of a fuller breast.

United States Patent App. Pub. No. US2013/0137340, in the name of Liu, discloses an underwire for a brassiere constructed from plastic material. Singapore Patent App. Pub. No. SG188025, in the name of Pai, also discloses an underwire for a brassiere constructed from a plastics material. It is understood that these underwires are relatively strong however both US2013/0137340 and SG188028 have a substantially rectangular cross-section which over time may cause discomfort to the wearer. U.S. Pat. No. 4,235,240 in the name of Cousins discloses an underwire that has a substantially rectangular cross-section with one or two flanges extending outwardly therefrom; however, it is believed that this construction may not provide adequate support to the fuller breast.

PCT Patent App. Pub. No. WO2014/146698 in the name of Lelong, discloses a three dimensional underwire for a brassiere in the shape of an arch. The cross section of the underwire is essentially a curvilinear triangle. This underwire is believed to be more comfortable and believed to provide improved support when compared with many of the existing offerings, yet it is still relatively stiff, as evidenced by the need for cuts along its length to promote bending in those places where cuts are provided. This stiffness may cause discomfort to the wearer, particularly if the brassiere is worn over an extended period of time.

It is an object of the present invention to provide an underwire for a brassiere, and a brassiere incorporating the underwire, that will provide more comfort or more support than wireless brassieres or brassieres with hard metal wires. It is a further object of the present invention to provide an underwire that is relatively inexpensive and simple to manufacture and that provides a useful choice to the consumer.

BRIEF SUMMARY OF THE INVENTION

According to the invention there is provided an underwire for a brassiere comprising an elongate substantially u-shaped body having a chest-engaging portion and a breast-engaging portion connected together along the length of the breast-engaging portion in a dogleg-shaped configuration, the breast-engaging portion having a shorter length dimension than the chest-engaging portion and being connected intermediate and spaced apart from the ends of the chest-engaging portion, thereby leaving only a substantially flat chest-engaging portion at each end of the elongate body.

Such underwire provides adequate support to the breast and, importantly, will be comfortable to wear. By having only a substantially flat chest-engaging portion at each end of the elongate body, this portion of the underwire will have a degree of resilience and will not poke into the breast. This configuration is more comfortable for the wearer and obviates the possibility of causing breast cancer. By having the chest-engaging portion and the breast-engaging portion connected in a dogleg-shaped configuration, the underwire will be sufficiently rigid in those places where the chest-engaging portion and the breast-engaging portion are connected and this will provide good support to the breast. It can be seen, therefore, that the underwire is sufficiently rigid in those places where the underwire needs to provide support and sufficiently flexible in those places where the underwire needs to give.

In one embodiment there is provided an underwire in which the breast-engaging portion tapers inwardly towards the chest-engaging portion at each end of the breast-engaging portion. This configuration is seen as being particularly useful. By having the breast-engaging portion tapering inwardly towards the chest-engaging portion, there is no sudden bend between the angled (dogleg-shaped) shaped portion of the underwire and the flat portion of the underwire which might be a point of weakness in the underwire and could cause discomfort.

In one embodiment there is provided an underwire in which the breast-engaging portion tapers inwardly towards the chest engaging portion over a length of up to 0.02 m.

In one embodiment there is provided an underwire in which the ends of the elongate body are rounded. Again, in this embodiment the rounded ends of the elongate body will not have a tendency to poke into the breast and will promote deflection of the underwire away from the breast.

In one embodiment there is provided an underwire in which the ends of the chest-engaging portion beyond the breast-engaging portion reduce in thickness towards the ends. By reducing in thickness towards the ends, the underwire will be more resilient and will be inclined to deflect away from the breast rather than poke into the breast under an exerted force.

In one embodiment there is provided an underwire in which the breast-engaging portion forms an angle of between about 110° and about 140° with the chest-engaging portion. This configuration provides a generally stiffer and very robust underwire that is capable of providing excellent support. This configuration also potentially allow less material to be used in the manufacture of the underwire.

In one embodiment there is provided an underwire which is constructed from a unitary piece of plastic material. By constructing the underwire from a unitary piece of plastic material, the underwire will be very simple and inexpensive to manufacture. Although it will be necessary to manufacture a separate underwire for each cup of a brassiere, it is believed that the overall cost reduction and benefits of having an underwire constructed from a unitary piece of plastic material will outweigh the disadvantages. Depending on the material chosen, it may be possible to avoid the need to provide an additional external soft coating layer on the underwire.

In one embodiment the underwire is constructed from polyurethane (PU).

In one embodiment the underwire is constructed from polyamide (PA).

In one embodiment the underwire is constructed from polyoxymethylene (POM).

In one embodiment the underwire is constructed from polyetheretherketone (PEEK).

In one embodiment there is provided a brassiere incorporating the underwire according to the embodiments described herein. The present underwire is seen as particularly suited to the sports bra market. It is envisaged that a bra incorporating the underwire will provide a more guided and better support to the breast and will move better with the body movements typically experienced with sports bras, in turn providing better comfort to the wearer.

In one embodiment there is provided a brassiere in which the underwire is sandwiched between an inner cup and an outer cup of the brassiere.

In one embodiment there is provided a brassiere in which the underwire is positioned in a tubular channel of the brassiere.

In one embodiment there is provided a brassiere in which at least one of the ends of the underwire body is stitched to the fabric of the brassiere. Either or both of the ends of the elongate body may be stitched directly to the fabric of the brassiere if a sufficiently soft material is used in the manufacture of the underwire. This will aid in the manufacture of the underwire brassiere and will also help to ensure that the ends of the underwire are unable to work free, thereby further obviating the possibility of the underwire poking into the breast of a wearer.

In one embodiment there is provided a garment incorporating the underwire. The garment may comprise a top, a camisole, a tank top, a swimsuit, a bikini, a dress, a shirt, a vest, a one-piece undergarment, a body shaper, nightwear, or other similar items that incorporate breast support.

Other embodiments, in addition to the embodiments enumerated above, will become apparent from the following detailed description, taken in conjunction with the accompanying drawings, which illustrate, by way of example, the principles of the underwire and garments incorporating same.

BRIEF DESCRIPTION OF THE DRAWINGS

The invention will now be more clearly understood from the following description of some embodiments thereof given by way of example only with reference to the accompanying drawings, in which.

DETAILED DESCRIPTION OF THE INVENTION

Figure 1:
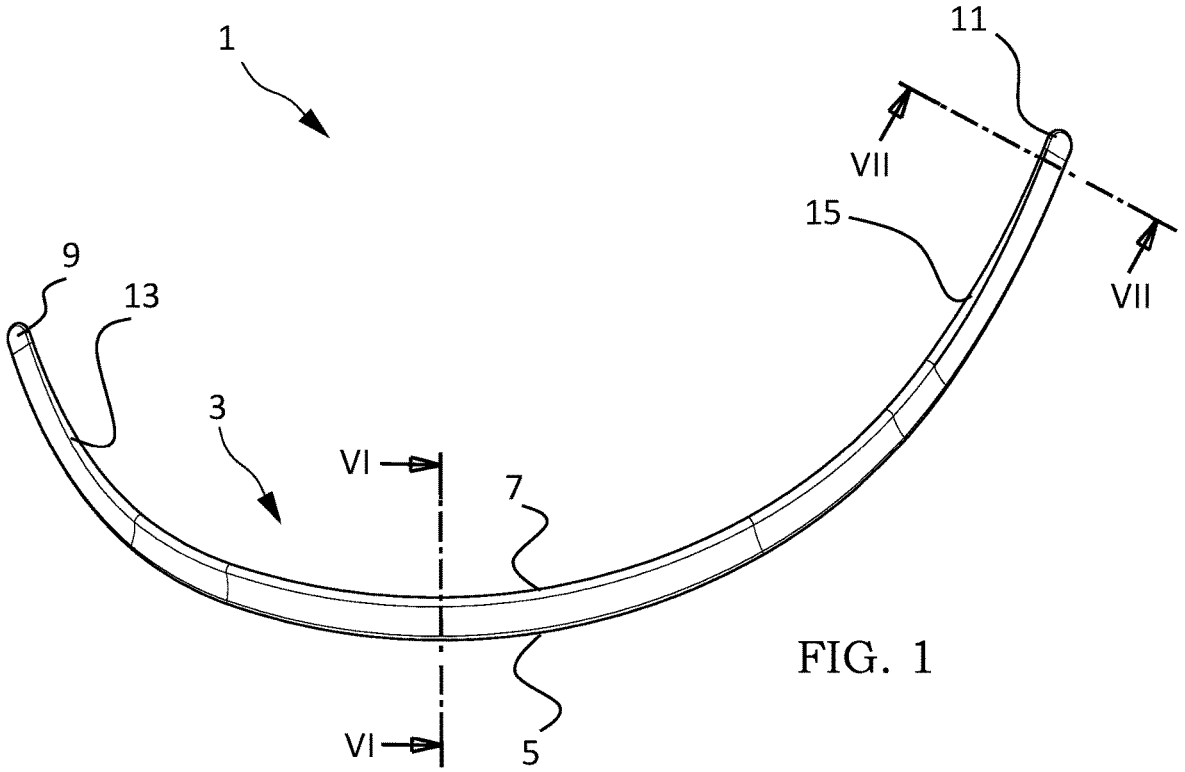
FIG. 1 is a front view of an underwire.
Figure 2:
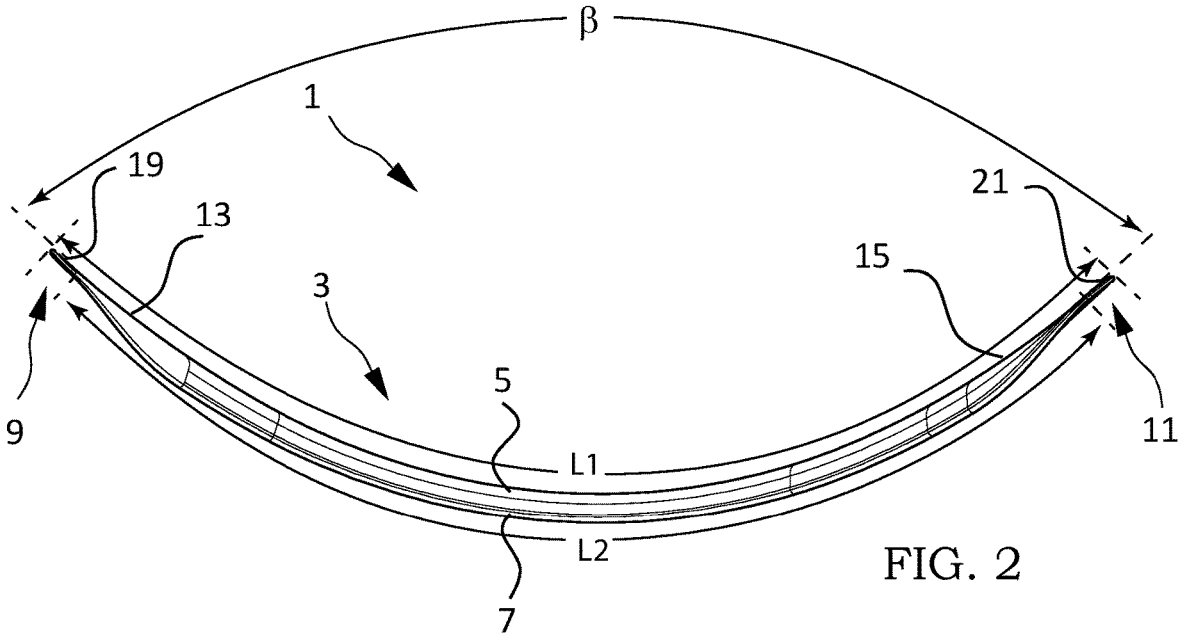
FIG. 2 is a top view of the underwire.

Referring to FIGS. 1 to 4 inclusive, there is shown an underwire, indicated generally by the reference numeral 1. The underwire comprises an elongate, substantially U-shaped body 3 (as illustrated best in FIG. 1) having a chest-engaging portion 5 (see especially FIG. 3B) and a breast-engaging portion 7. The chest-engaging portion 5 and the breast-engaging portion 7 are connected together along the length of the breast engaging portion 7 in a dogleg-shaped configuration (i.e., the breast-engaging portion extends outwardly from the chest-engaging portion at an obtuse angle). In use, the chest-engaging portion 5 lies flat against the wearer's chest while the breast-engaging portion 7 lies underneath and supports the wearer's breast. As used herein, the terms front, forward, and similar refer to the direction in front of the wearer, while the terms back, rear, rearward, and similar refer to the direction toward the wearer's back.

Figure 6:
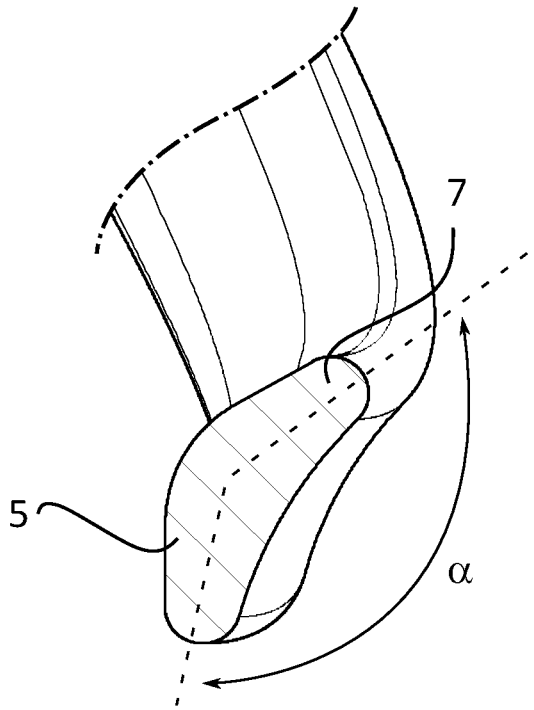
FIG. 6 is an enlarged partial cross-sectional view along line VI-VI of FIG. 1.

FIG. 6 is an enlarged partial cross-sectional view along line VI-VI of FIG. 1, illustrating the dogleg-shaped configuration of breast-engaging portion 7 and chest-engaging portion 5. In embodiments, the breast-engaging portion 7 extends outwardly from the chest-engaging portion 5 at an angle, $\alpha$, of the order of between 110° and 140°.

Figure 7:
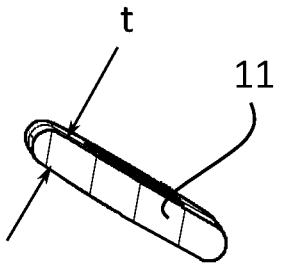
FIG. 7 is an enlarged cross-sectional view along line VII-VII of FIG. 1.

The breast-engaging portion 7 is shorter in length (L2, see FIG. 2) than the chest-engaging portion 5 (see L1, FIG. 2) and is connected to the chest-engaging portion 5 intermediate the ends of the chest-engaging portion 5. In this way, sections 9, 11 of the elongate body 3 at each of its ends beyond the ends of the breast-engaging portion 7 are substantially flat. FIG. 7 is a cross-sectional view along line VII-VII of FIG. 1, enlarged to the scale of FIG. 6, and illustrating substantially flat section 11.

Preferably, flat sections 9, 11 are rounded at their outermost ends and thinner than the remainder of the chest-engaging portion 5. In an exemplary embodiment, the thickness 't' (see FIG. 7) of the flat section is on the order of 0.8-0.9 mm, and may be directly stitched to a garment. In embodiments thickness 't' of the sections 9, 11 is about 50%-60% of the thickness of the central region of chest-engaging portion 5 (see FIG. 6).

Referring again to FIGS. 1-4, the breast-engaging portion 7 tapers towards the chest-engaging portion 5 at the ends of the breast-engaging portion 7 in tapered sections 13, 15. This configuration ensures that there is no sudden bend between the dogleg-shaped portion of the underwire (see FIG. 6) and the flat sections of the underwire (see FIG. 7). The tapered sections are each of the order of 0.02 meters (m) in length.

The flat sections 9, 11 at each end of the elongate body are preferably angled with respect to each other so that when the flat section 9 intended for engagement of the area at the sternum lies substantially flat along the sternum, the flat section 11 intended for engagement adjacent the side of the breast near the arm pit will also lie substantially flat along the wearer's body at that location. The body-facing surface 19 of the flat section 9 may be offset from the body-facing surface 21 of the flat section 11 by an angle of over 90° (e.g. angle β of FIG. 2), preferably of the order of between 100° to 150° (see, e.g., FIGS. 3A & 3B).

Figure 3A:
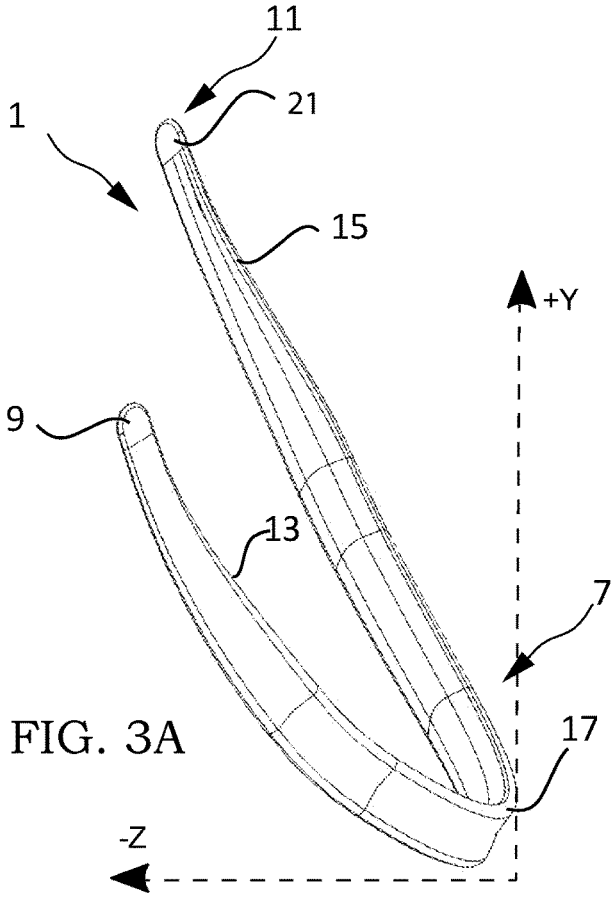
FIG. 3A is an enlarged left side view of the underwire.
Figure 3B:
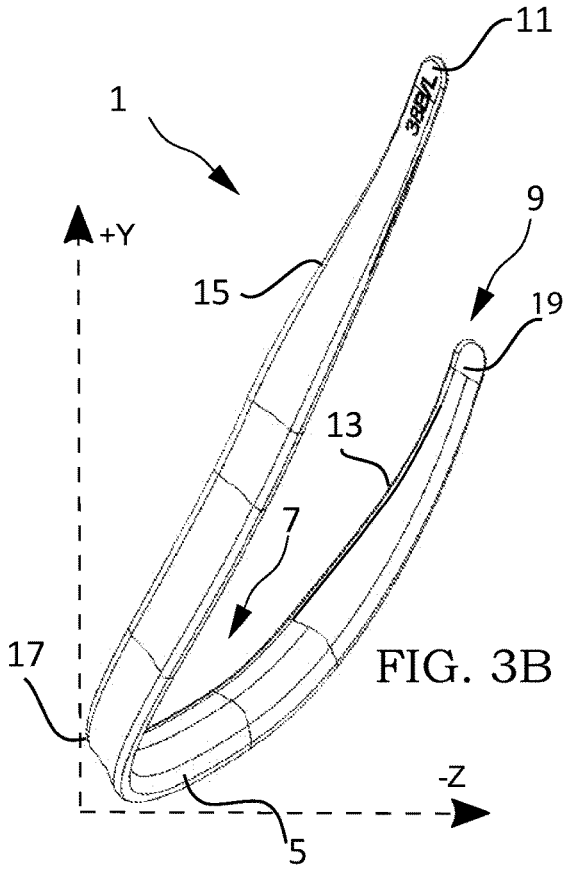
FIG. 3B is an enlarged right side view of the underwire.
Figure 4:
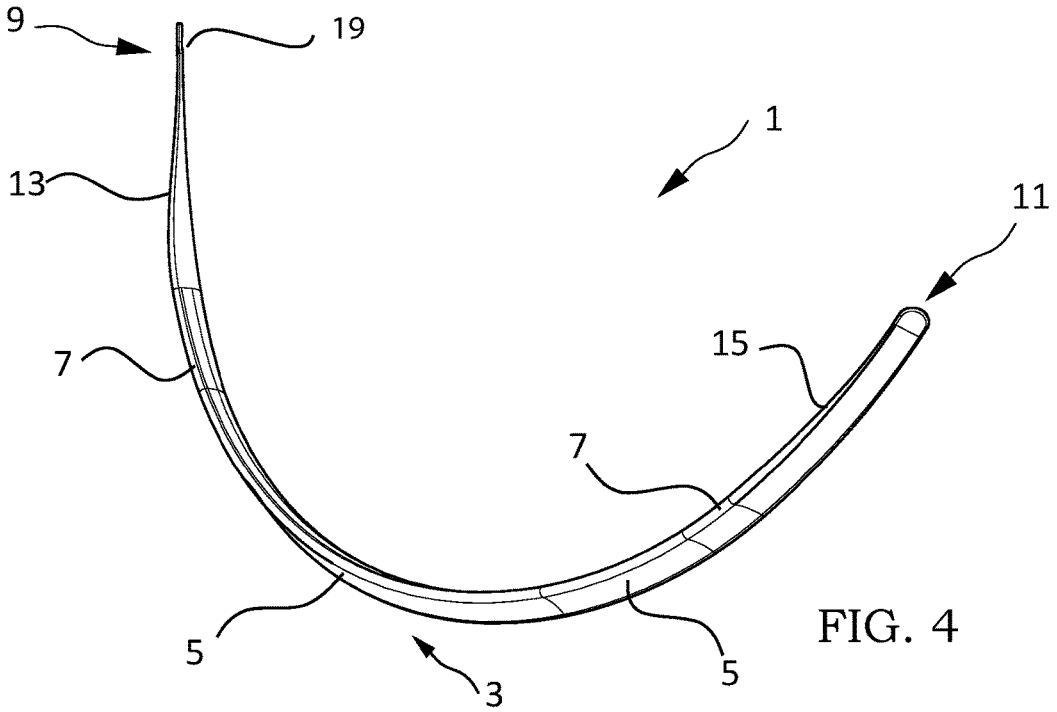
FIG. 4 is an isometric view of the underwire.

Referring to FIGS. 3A & 3B, breast-engaging portion 7 has a lowermost region 17 positioned below the wearer's breast when worn. Both ends 9 and 11 of the elongate body project rearwardly away from lowermost region 17 along the −Z axis as shown in FIGS. 3A &3B. In other words, lowermost region 17 is also the forwardmost region of the underwire 1, with ends 9 and 11 projecting toward the wearer's back when worn. The above features provides improved comfort as both ends are contoured toward the wearer's body and snuggly fit the body contour without poking or protruding toward the breast.

In the embodiment shown, the underwire is constructed from a single piece of molded plastic material. It is envisaged that several different plastic materials could be used to good effect including those deemed soft, semi-soft, hard, or very hard, however polyurethane (PU), polyamide (PA), polyoxymethylene (POM) and polyetheretherketone (PEEK) are all deemed particularly suitable materials that may be used in the manufacture of an underwire. The materials used may have a bearing on the dimensions of the underwire and a suitable material may be chosen to provide the desired structural rigidity within predetermined size constraints.

In the embodiment shown, an underwire for a left cup of a size 38B bra is illustrated. It will be understood that the underwire for the right cup of the bra (not shown) will be practically a mirror image (about a vertical axis) of the underwire for the left cup. The ends 9, 11 of the underwire can be stitched directly into the material of a bra provided the material chosen for the underwire is sufficiently thin or sufficiently soft. This direct stitching will further obviate the possibility of the end of the underwire poking into the breast of a wearer and causing discomfort or harm. The underwire may be sandwiched between an inner layer and an outer layer of a cup of the bra or may be placed in a tubular channel of the bra.

Figure 5:
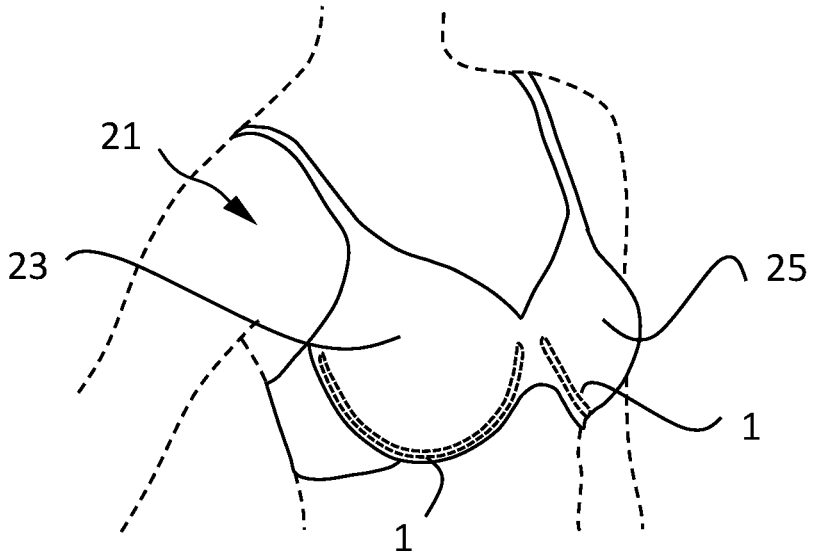
FIG. 5 is a diagrammatic representation of a brassiere incorporating the underwire and shown in use.

Referring to FIG. 5, there is shown a brassiere in use, indicated generally by the reference numeral 21. The brassiere 21 has a pair of cups 23, 25, each of which has an underwire 1 (shown in dotted outline) mounted therein. The underwires 1 are stitched into position in the cups 23, 25. It is envisaged that the underwire may also be incorporated into garments other than brassieres per se where it is desired to provide a degree of support to the wearer's breast. For example, the underwire may also be provided in tops, camisoles, tank tops, swimsuits, bikinis, dresses, shirts, vests, one-piece undergarments, body shapers, nightwear, and other items that incorporate breast support.

Throughout this specification the terms "comprise, comprised, comprises and comprising" and the terms "include, includes, included and including" have been used interchangeably and should be afforded the widest possible interpretation.

The embodiments of the underwire described herein and garments incorporating same are exemplary and numerous modifications, combinations, variations, and rearrangements can be readily envisioned to achieve an equivalent result, all of which are intended to be embraced within the scope of the appended claims. Further, nothing in the above-provided discussions of the underwire and garments should be construed as limiting the invention to a particular embodiment or combination of embodiments. The scope of the invention is defined by the appended claims.

We claim:

1. An underwire of a brassiere having a pair of cups, the underwire comprising:

an elongate substantially u-shaped body having:

a chest-engaging portion terminating in two ends, the two ends being substantially flat chest-engaging portions, one substantially flat chest-engaging portion being configured to lie substantially flat along a wearer's sternum and the other substantially flat chest-engaging portion being configured to lie substantially flat along a side of a wearer's breast; and a breast-engaging portion connected to the chest-engaging portion along the entire length of the breast engaging portion, the breast-engaging portion extending outwardly from the chest-engaging portion at an obtuse angle, and the breast-engaging portion having two ends;

the breast-engaging portion having a shorter length dimension than the chest-engaging portion and being connected intermediate and spaced apart from the ends of the chest-engaging portion;

the breast-engaging portion having a lowermost region configured to be positioned below a wearer's breast;

both of the substantially flat chest-engaging portions projecting toward a wearer's back and away from the lowermost region of the breast-engaging portion; and wherein the substantially flat chest-engaging portions are angled with respect to each other, and the body-facing surface of the one substantially flat chest-engaging portion is offset from the body-facing surface of the other substantially flat chest-engaging portion by an angle of between 100 to 150 degrees; and wherein the underwire is configured to be mounted in one of the cups.

2. The underwire of claim 1 wherein the breast-engaging portion tapers inwardly towards the chest-engaging portion at each end of the breast-engaging portion adjacent one of the substantially flat chest-engaging portions.

3. The underwire of claim 2 wherein the breast-engaging portion tapers inwardly towards the chest-engaging portion over a length of up to 0.02 meters.

4. The underwire of claim 2 wherein the ends of the elongate body are rounded.

5. The underwire of claim 2 wherein the ends of the chest-engaging portion beyond the breast-engaging portion reduce in thickness towards the ends of the elongate body.

6. The underwire of claim 1 wherein the ends of the elongate body are rounded.

7. The underwire of claim 1 wherein the ends of the chest-engaging portion beyond the breast-engaging portion reduce in thickness towards the ends of the elongate body.

8. The underwire of claim 1 wherein the breast-engaging portion forms an angle of between about 110° and about 140° with the chest-engaging portion.

9. The underwire of claim 1 further being constructed from a unitary piece of plastic material.

10. The underwire of claim 9 wherein the plastic material includes polyurethane.

11. The underwire of claim 9 wherein the plastic material includes polyamide.

12. The underwire of claim 9 wherein the plastic material includes polyoxymethylene.

13. The underwire of claim 9 wherein the plastic material includes polyetheretherketone.

14. A brassiere comprising: a pair of cups, each of the cups including an outer layer and having an underwire mounted internal to the outer layer, the underwire comprising: an elongate substantially u-shaped body having:

a chest-engaging portion terminating in two ends, the two ends being substantially flat chest-engaging portions, one substantially flat chest-engaging portion being configured to lie substantially flat along a wearer's sternum and the other substantially flat chest-engaging portion being configured to lie substantially flat along a side of a wearer's breast; and a breast-engaging portion connected to the chest-engaging portion along the entire length of the breast engaging portion, the breast-engaging portion extending outwardly from with the chest-engaging portion at an obtuse angle, and the breast-engaging portion having two ends;

the breast-engaging portion having a shorter length dimension than the chest-engaging portion;

the breast-engaging portion having a lowermost region configured to be positioned below a wearer's breast;

both of the substantially flat chest-engaging portions projecting toward a wearer's back and away from the lowermost region of the breast-engaging portion; and wherein the substantially flat chest-engaging portions are angled with respect to each other, and the body-facing surface of the one substantially flat chest-engaging portion is offset from the body-facing surface of the other substantially flat chest-engaging portion by an angle of between 100 to 150 degrees.

15. The brassiere of claim 14, each of the cups including an inner layer, wherein the underwire is sandwiched between the inner layer and the outer layer.

16. The brassiere of claim 14 having a tubular channel, wherein the underwire is positioned in the tubular channel.

17. The brassiere of claim 14 comprising fabric, wherein at least one of the ends of the elongate body is stitched to the fabric.

18. The brassiere of claim 14 being a sports brassiere.

* * * * *